United States Patent [19]

Kamiyama

[11] Patent Number: 4,527,883

[45] Date of Patent: Jul. 9, 1985

[54] MOUNTING STRUCTURE FOR CYLINDRICAL PHOTOSENSITIVE MEMBER

[75] Inventor: Shin-ichi Kamiyama, Kanagawa, Japan

[73] Assignee: Ricoh Company Ltd., Japan

[21] Appl. No.: 398,789

[22] Filed: Jul. 16, 1982

[30] Foreign Application Priority Data

Jul. 17, 1981 [JP] Japan ..... 56-106214[U]

[51] Int. Cl.[3] ..... G03G 15/00

[52] U.S. Cl. ..... 355/3 DR; 248/544

[58] Field of Search ..... 355/3 DR, 3 R; 29/123; 101/375, 378; 248/544

[56] References Cited

U.S. PATENT DOCUMENTS 4,120,576 10/1978 Babish ..... 355/3 DR 4,253,758 3/1981 Cormier ..... 355/3 DR

*Primary Examiner*—John F. Gonzales

*Assistant Examiner*—J. Pendegrass

*Attorney, Agent, or Firm*—Guy W. Shoup

[57] ABSTRACT

A mounting structure for cylindrical photosensitive member comprises a pair of end plates of the photosensitive member which are detachably mounted on a support shaft, which is locked against axial movement on a stationary frame. The support shaft includes a portion which bears against the internal periphery of the photosensitive member to support it with respect to the shaft, and is also provided with an axially movable guide member. The movement of the guide member is limited to an extent which is useful in mounting and dismounting the photosensitive member on or from the support shaft, by means of a stop mounted on the support shaft. The photosensitive member is mounted on or dismounted from the support shaft with the guide member interposed therebetween.

6 Claims, 3 Drawing Figures

MOUNTING STRUCTURE FOR CYLINDRICAL PHOTOSENSITIVE MEMBER

BACKGROUND OF THE INVENTION

A cylindrical photosensitive member as used in a copying machine is mounted on or dismounted from a support or center shaft which is fixedly mounted on the frame of the machine by an axial movement for purpose of replacement, maintenance or inspection.

Generally, a cylindrical photosensitive member is open at at least one end thereof because of its manufacturing limitation, and such opening is closed by an end plate only after the photosensitive member is brought to its normal mounting position on a support shaft, thereby preventing a misalignment and providing a reliable support. Accordingly, in the course of mounting the cylindrical photosensitive member on the support shaft or dismounting it from the latter, there is a high likelihood that the photosensitive member may be misaligned with respect to the support shaft. As is well known, the photosensitive member carries a vulnerable photosensitive layer as may be formed with selenium, on its outer periphery, and the photosensitive member is mounted in a surrounding environment which contains a charger, developing unit, neutralizer and the like. Hence if the photosensitive member is misaligned during its mounting or dismounting process, a contact thereof with the surrounding units may cause a damage to the photosensitive layer.

Accordingly, a variety of guiding apparatus have been proposed in the prior art for guiding the photosensitive member in the axial direction without causing any misalignment during the mounting or dismounting thereof. Such apparatus may be assembled into a copying machine or may be separate from the latter.

For a guiding apparatus which is to be assembled into a copying machine, there is a disadvantage that it must occupy a certain space which may be utilized for other devices. For a guiding apparatus which is separate from a copying machine, the apparatus must be attached to the machine as required. This results in a degraded quality of maintenance and disadvantageously requires a special space for its stowage when not in use.

SUMMARY OF THE INVENTION

In order to eliminate described disadvantages, it is an object of the invention to provide a mounting structure for cylindrical photosensitive member which is simple to operate and which enables a reliable guiding action without invading any space which is occupied by other devices.

The above object is achieved in accordance with the invention by a mounting structure for cylindrical photosensitive member having a pair of end plates at its opposite ends which are effective to support the member on a support shaft. The support shaft is carried by a frame at its one end, and the cylindrical photosensitive member is open at at least its one end to allow an axial movement of the photosensitive member toward one end of the support shaft as the opening of the photosensitive member is fitted over the other end of the support shaft. When the photosensitive member reaches its mounting position with respect to the support shaft, the end of the photosensitive member adjacent to the opening engages one of the end plates which is mounted on said one end of the support shaft, thus allowing such end to be supported by the support shaft through said end plate. The support shaft is provided with a guide member disposed for engagement with the internal periphery of the photosensitive member to carry it with respect to the support shaft and also disposed for axial movement as the photosensitive member moves axially relative to the support shaft. The support shaft is also provided with a stop which cooperates with the guide member to limit the movement thereof to an extent which is effective to permit a mounting or dismounting of the photosensitive member with respect to the support shaft.

In accordance with the invention, the internal space within the cylindrical photosensitive member, which has been left as a dead space in the prior art, is effectively utilized to permit a simple and reliable mounting and dismounting of the cylindrical photosensitive member with respect to the support shaft while avoiding any damage to the photosensitive layer.

The utilization of the internal space within cylindrical photosensitive member brings forth advantages that no invasion occurs into spaces occupied by other devices and that the operation can be efficiently achieved since the mounting or dismounting may be performed any time required.

DESCRIPTION OF EMBODIMENT

Figure 1:
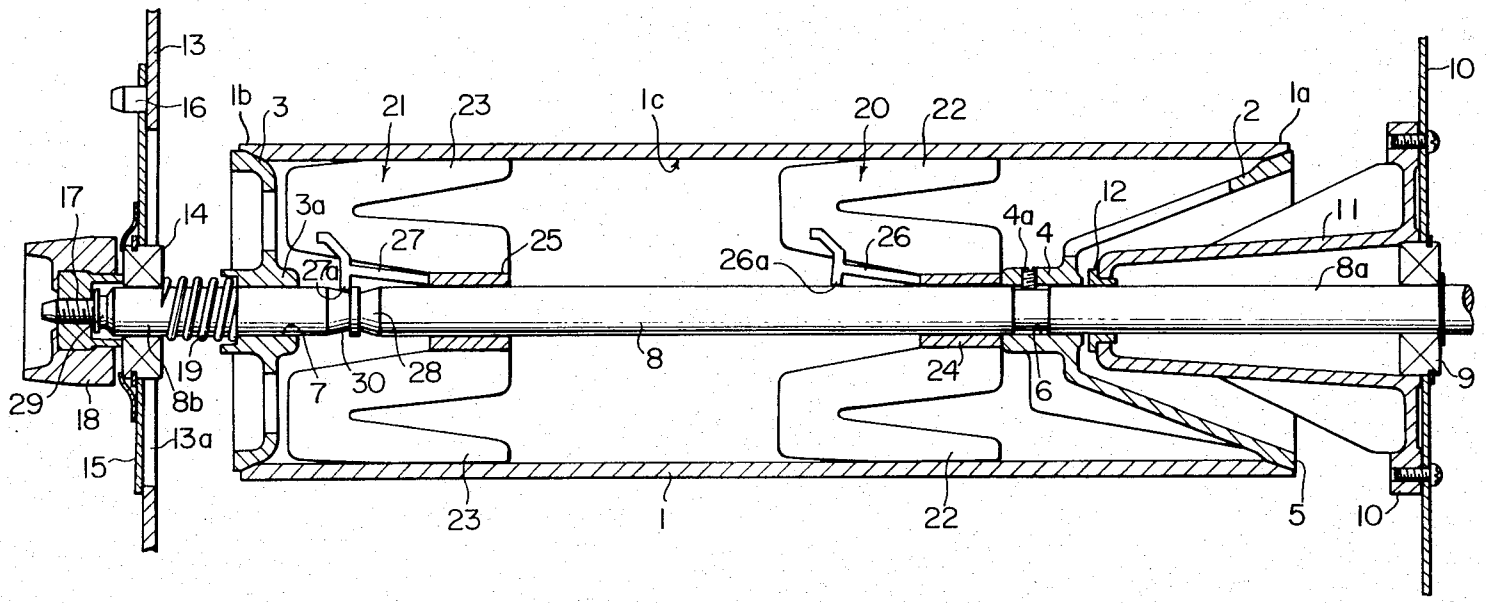
FIG. 1 is a longitudinal section of a mounting structure according to one embodiment of the invention, illustrating a cylindrical photosensitive member mounted in place by means of such structure.
Figure 2:
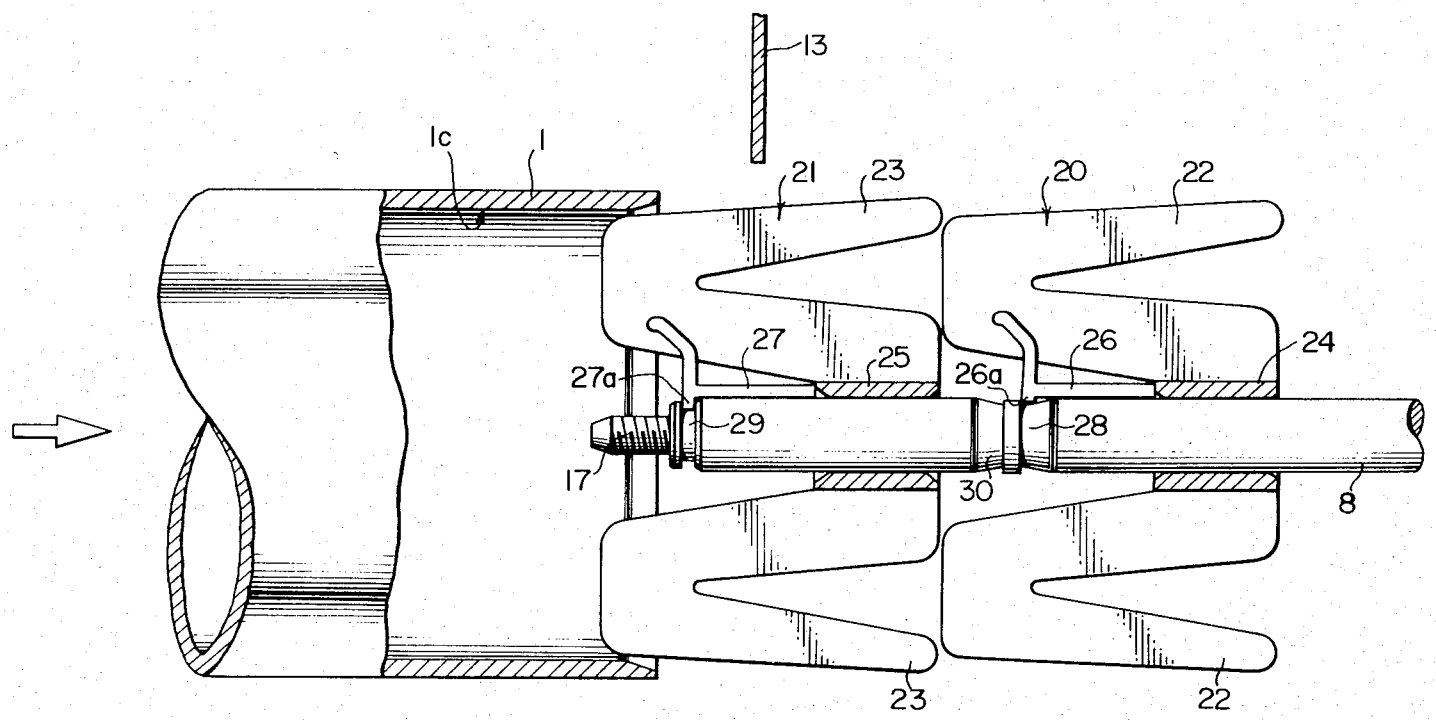
FIG. 2 is an enlarged longitudinal section of part of the mounting structure.

Referring to FIG. 1, there is shown a mounting structure for cylindrical photosensitive member according to one embodiment of the invention, and FIG. 2 illustrates the operation thereof. In FIGS. 1 and 2, a cylindrical photosensitive member 1 carries a photosensitive layer on its outer periphery, and is open at its opposite ends 1*a*, 1*b*, which are tapered and into which fixed end plate 2 and removable end plate 3 are fitted. Both of which are disc-shaped. The end plates are centrally provided with hubs 4, 5, in which bores 6, 7 are formed to receive a support shaft 8 passing therethrough. One end 8*a* of the support shaft 8 is rotatably supported by a ball bearing 9 and a metal bearing 12, carried by a bracket 11 which is in turn fixedly mounted on a rear panel 10. The fixed end plate 2 is secured, by a machine screw 4*a*, to the support shaft adjacent said one end. The support shaft 8 extends through the bore 6 in the end plate 2, the interior of the photosensitive member 1 and the bore 7 in the removable end plate 3, whereby its other end 8*a* extends through an opening 13*a* formed in a front panel 13, and the other end 8*b* is rotatably carried by a ball bearing 14 which is in turn supported by a mounting plate 15. The mounting plate 15 engages with a plurality of locating pins 16 mounted on the front panel 13 (only one being shown), whereby they are anchored thereto. The free end of the support shaft 8 is formed with threads 17, which are engaged by a lock nut 18. As the lock nut 18 is tightened, a thrust directed to the right, as viewed in FIG. 1, is applied to the removable end plate 3 through the ball bearing 14 and a coiled compression spring 19, one end of which is a press fit in the hub 5. In this manner, the cylindrical photosensitive member 1 is supported concentrically on the support shaft 8. It will be noted that the lock nut 18 is carried by the mounting plate 15.

Figure 3:
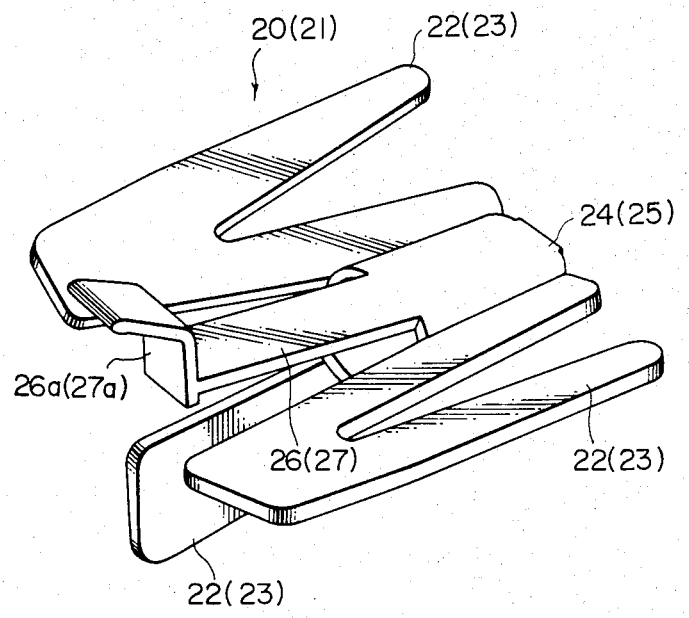
FIG. 3 is a perspective view of a guide and support member, used in the arrangement of the invention.

A pair of guide and support members 20, 21 for the photosensitive member 1 are mounted on the support shaft 8. As shown in FIG. 3, each of the members 20, 21 is molded from a suitable synthetic resin, and includes three guide vanes 22 or 23 which have resilience in a diametrical direction, and a hub 24 or 25 which is fitted over the support shaft 8 while allowing its axial movement. The guide vanes 22 or 23 of the member 20 or 21 resiliently engage the internal peripheral surface of the photosensitive member 1 to support the latter with respect to the support shaft 8. As the photosensitive member 1 moves axially of the support shaft, the guide and support members also slide along the support shaft 8. It is also to be noted that each of the guide and support members 20, 21 is integrally formed with a resilient stop 26 or 27. The stop 26 includes a lug 26*a* which is selectively engaged with a stop groove 28 formed circumferentially in the support shaft 8 toward the free end thereof to prevent a movement of the guide and support member 20 to the left, as viewed in FIG. 1, of location of the stop groove 28. The stop 27 also includes a lug 27*a* which is selectively engaged with a stop groove 29 formed circumferentially in the free end of the support shaft 8 to prevent a displacement of the member 21. The lug 27*a* also selectively engages a stop groove 30 formed in contiguous manner with the stop groove 28 to prevent a movement of the guide and support member 21 to the right, as viewed in FIG. 1, of the location of the stop groove 30.

FIG. 1 shows the cylindrical photosensitive member 1 as mounted on the support shaft 8. The procedure to dismount the photosensitive member 1 from the shaft 8 will now be described. The lock nut 18 is initially turned to disengage it from the threads 17 on the shaft 8. The ball bearing 14 is also withdrawn from the shaft together with the lock nut 18, whereby the mounting panel 15 which carries it is also separated from the front panel 13, thus leaving the opening 13*a* in the front panel 13 open.

Accessing through the opening 13*a*, the end plate 3 is disengaged from the end 1*b* of the photosensitive member 1, thus allowing it to be withdrawn from the support shaft 8 together with the compression spring 19. Holding the end 1*b* of the photosensitive member 1, the latter may be pulled to the left, as viewed in FIG. 1, whereupon the other end 1*a* is disengaged from the end plate 2 to allow the photosensitive member 1 to be moved to the exterior while the guide and support members 20, 21 slide over the shaft 8.

When the lug 27*a* of the support member 21, which resiliently bears against the internal peripheral surface of the photosensitive member 1, becomes engaged with the stop groove 29 as shown in FIG. 2, a further movement of the support member 21 is blocked, the photosensitive member 1 may continue to move to the left, whereby the other support member 20 is pulled in the same direction. When the lug 26*a* of the support member 20 engages the stop groove 28, a further movement of the member 20 to the left is blocked. The photosensitive member 1 can be entirely withdrawn out of the machine while its internal surface 1*c* slides over the guide vanes 23, 22 of the support members 21, 20 which are blocked against movement in the direction of withdrawal. When the photosensitive member 1 is so withdrawn, the guide and support member 21 partly projects forwardly through the opening 13*a* in the front panel 13, as shown in FIG. 2. It is maintained at this position by the engagement between the lug 27*a* and the stop groove 29.

The procedure of mounting the cylindrical photosensitive member 1 will now be described. In FIG. 2, the photosensitive member 1 is centered with respect to the axis of the support shaft 8, and its end opening 1*a* is engaged with the guide and support member 21. Subsequently, the photosensitive member may be driven to the right while its inner periphery slides over the guide vanes 23. In this manner, the guide vanes 23 are fitted inside the periphery of the photosensitive member 1, and the guide and support member 21 supports the end opening with respect to the support shaft 8. As the photosensitive member 1 continues to be driven to the right until the end opening 1*a* engages the guide vanes 22 of the guide and support member 20, the lug 26*a* of the latter is driven out of the stop groove 28 and then continues to move along the support shaft 8. At this time, the guide vanes 22 support the photosensitive member 1 so as to prevent this end thereof from being displaced diametrically with respect to the support shaft. The guide and support member 21 which is locked in place continues to guide the movement of the photosensitive member 1 while the inner peripheral surface 1*c* of the latter slides over the guide vanes 23.

When the hub 24 of the moving support member 20 abuts against the hub 4 of the end plate 2, a further movement of the member 20 to the right is prevented. As the photosensitive member 1 is further driven to the right, the guide and support member 21 becomes exposed out of the end 1*b* thereof, thereby rocking the stop 27 to disengage the lug 27*a* from the stop groove 29.

Subsequently, as the photosensitive member 1 continues to be driven to the right, the guide and support member 21 follows such movement until its lug 27*a* becomes engaged with the stop groove 30, whereupon its further movement is blocked. Both guide and support members 20, 21 now assume their positions illustrated in FIG. 1. A further movement of the photosensitive member 1 allows its end opening 1*a* to be fitted over the end plate 2.

At this time, the cylindrical photosensitive member 1 is supported at two axially spaced points with respect to the support shaft 8 by means of the guide and support members 20, 21. It will be seen that the photosensitive member is maintained supported by the shaft 8 without causing any misalignment from the very beginning of the mounting operation until the end opening 1*a* is engaged with the end plate 2. After the photosensitive member is mounted in its normal position illustrated in FIG. 1, the end plate 3 is fitted over the free end of the support shaft 8 to be engaged with the end opening 1*b* of the photosensitive member 1. Subsequently, the mounting plate 15 is mounted on the support shaft 8, and the lock nut 18 threadably engages with the threads 17 to complete the mounting of the photosensitive member 1.

It will be seen from the foregoing description that the invention has provided a mounting structure for cylindrical photosensitive member, including a guide mechanism which reliably guides the photosensitive member 1 as it is mounted and dismounted while effectively utilzing the internal space therein which has been a dead space in the prior art practice.

In the embodment shown, the guide and support members 20, 21 are constructed in an identical manner, thereby advantageously allowing a shared use as either member. However, the guide and support member 20 which guides and supports the inner portion of the cylindrical member 1 may not be provided with the stop 26. In this instance, the guide and support 20 will be prevented from moving to the left by abutment against the other guide and support member 21 which is positioned by the engagement between the lug 27*a* and the stop groove 29 under the situation illustrated in FIG. 2.

What is claimed is:

1. A mounting structure for mounting a cylindrical photosensitive member on a support shaft; comprising a support shaft which has its one end carried by a frame;

a stationary end plate mounted on said end of the support shaft and disposed for receiving, by a fitting engagement, one end opening of a cylindrical photosensitive member as the latter is brought to its normal mounting position on the support shaft;

a movable end plate detachably mounted on the support shaft for receiving, by a fitting engagement, the other end opening of the photosensitive member when the latter has been brought to its normal mounting position on the support shaft;

a guide and support member disposed for free movement on the support shaft, the guide and support member being configured for resilient contact with the inner peripheral surface of the photosensitive member to support it with respect to the support shaft and being adapted for axial movement along the support shaft as the photosensitive member moves axially with respect to the support shaft; and stop means mounted on the support shaft for limiting the movement of the guide and support member to an extent which is effective for allowing a mounting or dismounting of the cylindrical photosensitive member onto or from the support shaft.

2. A mounting structure according to claim 1 in which each of the end plates has a tapered end in fitting engagement with the associated end of the cylindrical photosensitive member.

3. A mounting structure according to claim 1 in which the guide and support member includes a plurality of resilient guide vanes which are disposed for contact with the inner peripheral surface of the cylindrical photosensitive member.

4. A mounting structure according to claim 1 in which a plurality of said guide and support members are provided.

5. A mounting structure according to claim 1 in which the stop means comprises a stop groove formed in the support shaft.

6. A mounting structure according to claim 5 in which said stop groove is formed in the end of the support shaft opposite said one end.

* * * * *